US009158254B2

(12) United States Patent
Hagiwara

(10) Patent No.: US 9,158,254 B2
(45) Date of Patent: Oct. 13, 2015

(54) IMAGE FORMING APPARATUS, IMAGE FORMING METHOD, PRINT SETTING METHOD OF IMAGE FORMING APPARATUS, AND COMPUTER-READABLE RECORDING MEDIUM ON WHICH PRINT SETTING PROGRAM OF IMAGE FORMING APPARATUS IS RECORDED

(75) Inventor: Takahiro Hagiwara, Chiba-ken (JP)

(73) Assignees: Kabushiki Kaisha Toshiba, Tokyo (JP); Toshiba Tec Kabushiki Kaisha, Tokyo (JP)

( * ) Notice: Subject to any disclaimer, the term of this patent is extended or adjusted under 35 U.S.C. 154(b) by 516 days.

(21) Appl. No.: 13/160,773

(22) Filed: Jun. 15, 2011

(65) Prior Publication Data

US 2011/0310422 A1 Dec. 22, 2011

Related U.S. Application Data

(60) Provisional application No. 61/355,837, filed on Jun. 17, 2010.

(51) Int. Cl.
*G03G 15/00* (2006.01)

(52) U.S. Cl.
CPC ..... *G03G 15/5016* (2013.01); *G03G 15/502* (2013.01); *G03G 15/5087* (2013.01); *G03G 2215/00109* (2013.01); *G03G 2215/00932* (2013.01)

(58) Field of Classification Search
CPC ..... G03G 15/502; G03G 15/5016
See application file for complete search history.

(56) References Cited

U.S. PATENT DOCUMENTS

| | | | | |
|---|---|---|---|---|
| 2004/0080787 | A1 * | 4/2004 | Kakikawa et al. | 358/1.18 |
| 2004/0141203 | A1 * | 7/2004 | Honma | 358/1.15 |
| 2004/0184830 | A1 | 9/2004 | Miyamoto | |
| 2005/0088684 | A1 * | 4/2005 | Naito et al. | 358/1.15 |
| 2007/0236720 | A1 | 10/2007 | Tamada et al. | |
| 2008/0278749 | A1 | 11/2008 | Sato | |
| 2009/0044111 | A1 | 2/2009 | Eun | |

FOREIGN PATENT DOCUMENTS

| | | | | |
|---|---|---|---|---|
| EP | 1983380 | | 10/2008 | |
| EP | 2172813 | | 4/2010 | |
| JP | 2000225770 | A * | 8/2000 | B41M 5/26 |

OTHER PUBLICATIONS

Machine translation of prior art JP 2000225770.*

* cited by examiner

*Primary Examiner* — Saeid Erbrahimi Dehkord
*Assistant Examiner* — Lennin Rodriguezgonzale
(74) *Attorney, Agent, or Firm* — Amin, Turocy & Watson, LLP

(57) ABSTRACT

In general, according to one embodiment, an image forming apparatus includes a display unit, an operation input unit, a storage unit, a control unit, and an image forming unit. The operation input unit receives an operation input. The storage unit stores function restriction instruction content that disables setting and use of a predetermined function related to printing, so as to correspond to a sheet handling method after image formation. The control unit displays a setting screen for setting each function related to printing and selecting the sheet handling method on the display unit, acquires the function restriction instruction content corresponding to the selected sheet handling method from the storage unit when the sheet handling method is selected, displays the setting screen in which setting and use of the predetermined function are disabled on the display unit on the basis of the acquired function restriction instruction content, and receives print setting on the setting screen. The image forming unit is controlled by the control unit on the basis of the setting received on the setting screen and forms an image on a sheet.

16 Claims, 12 Drawing Sheets

FIG.5

237

| OPTION SETTING / LIFE CYCLE | STAPLING FUNCTION | HOLE PUNCHING FUNCTION | N IN 1 PRINTING FUNCTION | SINGLE-SIDED PRINTING FUNCTION | PLAIN PAPER USE FUNCTION | REAR PAPER USE FUNCTION | REUSABLE (LESS THAN 5 TIMES) PAPER USE FUNCTION | REUSABLE (5 OR MORE TIMES) PAPER USE FUNCTION |
|---|---|---|---|---|---|---|---|---|
| INCINERATION | ALLOW | ALLOW | ALLOW | ALLOW | PROHIBIT | ALLOW | PROHIBIT | ALLOW |
| SHREDDING | PROHIBIT | ALLOW | ALLOW | ALLOW | ALLOW | ALLOW | PROHIBIT | ALLOW |
| REUSE AFTER ERASURE | PROHIBIT | PROHIBIT | ALLOW | ALLOW | PROHIBIT | PROHIBIT | ALLOW | PROHIBIT |
| RECYCLE SEPARATION (AS RECYCLED PAPER) | ALLOW | ALLOW | PROHIBIT | PROHIBIT | ALLOW | PROHIBIT | PROHIBIT | ALLOW |
| EXTERNAL DISTRIBUTION | ALLOW | ALLOW | ALLOW | ALLOW | ALLOW | PROHIBIT | PROHIBIT | ALLOW |

IMAGE FORMING APPARATUS, IMAGE FORMING METHOD, PRINT SETTING METHOD OF IMAGE FORMING APPARATUS, AND COMPUTER-READABLE RECORDING MEDIUM ON WHICH PRINT SETTING PROGRAM OF IMAGE FORMING APPARATUS IS RECORDED

CROSS-REFERENCE TO RELATED APPLICATION

This application is based upon and claims the benefit of priority from U.S. provisional application 61/355,837, filed on Jun. 17, 2010; the entire contents of which are incorporated herein by reference.

FIELD

Embodiments described herein relate to a technique capable of reducing additional work during handling of a sheet after image formation.

BACKGROUND

Hitherto, an image forming apparatus is known which prints the separation category for a shredder or the like on a margin to achieve an efficient separation operation during printing. The apparatus determines the disposal categories from information such as quality or size of a sheet, kind of ink used for printing (color or monochrome), or printing ratio and prints the disposal categories on sheets. However, even though the disposal categories are printed on the sheet using the apparatus, for example, when the sheets are stapled during printing, the staple needs to be removed from the sheets for shredding during disposal, so that additional work cannot be reduced during disposal.

In addition, in recent years, an image forming apparatus is known which forms an image on a sheet using color-erasable toner of which color is erased by heating. When a sheet on which an image is formed by color-erasable toner is heated, the image on the sheet can be erased, thereby the sheet can be reused. However, even though the image is formed using the color-erasable toner, for example, when the sheets are stapled, the staple needs to be also removed from the sheets during color erasure. As such, in the image forming apparatuses according to the related art, additional work cannot be reduced during disposal or reuse processes.

DESCRIPTION OF THE DRAWINGS

FIG. 5 is a diagram showing a setting table.

DETAILED DESCRIPTION

In general, according to one embodiment, an image forming apparatus includes: a display unit, an operation input unit, a storage unit, a control unit, and an image forming unit. The operation input unit receives an operation input. The storage unit stores function restriction instruction content that disables setting and use of a predetermined function related to printing, so as to correspond to a sheet handling method after image formation. The control unit displays a setting screen for setting each function related to printing and selecting the sheet handling method on the display unit, acquires the function restriction instruction content corresponding to the selected sheet handling method from the storage unit when the sheet handling method is selected, displays the setting screen in which the setting and use of the predetermined function are disabled on the display unit on the basis of the acquired function restriction instruction content, and receives a print setting on the setting screen.

The image forming unit is controlled by the control unit on the basis of the setting received on the setting screen and forms an image on a sheet.

Hereinafter, embodiments will be described with reference to the drawings.

First Embodiment

Figure 1:
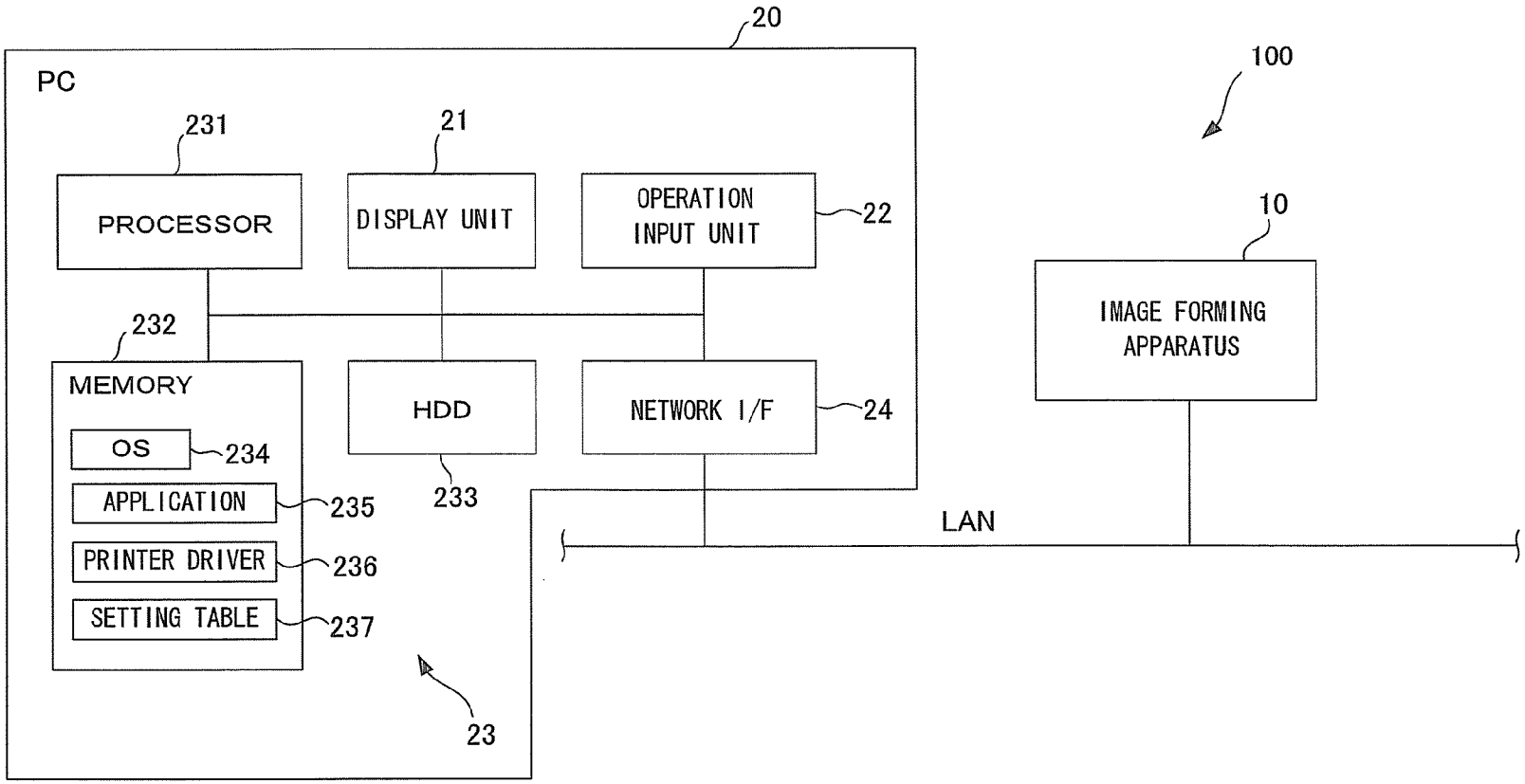
FIG. 1 is a diagram showing the configuration of a print system.

FIG. 1 is a diagram showing the configuration of a print system 100.

The print system 100 includes a plurality of image forming apparatuses 10 and a plurality of PCs 20 (Personal Computer, information terminal). In FIG. 1, only a single image forming apparatus 10 and a single PC 20 are shown. The image forming apparatus 10 and the PC 20 are connected to each other with a telecommunication line such as a LAN.

Figure 2:
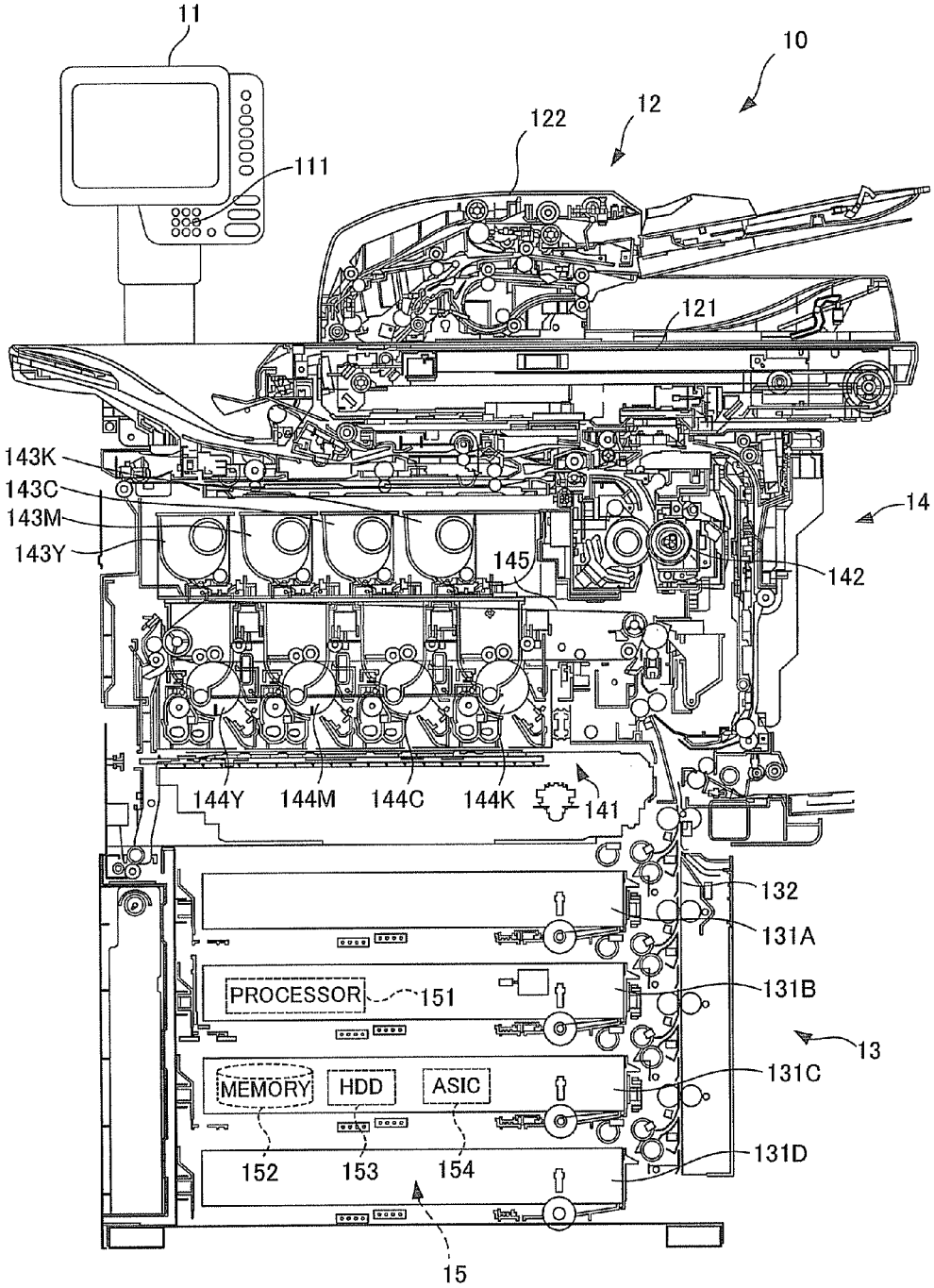
FIG. 2 is a diagram showing the configuration of an image forming apparatus.

FIG. 2 is a diagram showing the configuration of an image forming apparatus 10.

The image forming apparatus 10 is an MFP (Multi Function Peripheral). The image forming apparatus 10 forms an image on a sheet using a "color-erasable colorant" such as color-erasable toner or color-erasable ink. The image forming apparatus 10 may also function as a color erasing apparatus that executes a color erasing process for erasing the color of the color-erasable colorant on the sheet on which the image is formed by the color-erasable colorant.

The image forming apparatus 10 includes a display unit 11, an image reading unit 12, a sheet supply unit 13, an image forming unit 14, and a control unit 15. The display unit 11 displays an image. The display unit 11 includes an operation input unit 111 that receives an operation input. The image reading unit 12 includes a reading unit 121 that reads an original document, and an ADF 122 (Auto Document Feeder) that passes sheets to the reading unit 121. The sheet supply unit 13 includes cassettes 131A to 131D in which sheets are stored, and a transport path 132 that transports the sheets taken out of the cassettes 131A to 131D to the image forming unit 14. The cassette 131A stores plain paper, the cassette 131B stores rear paper, the cassette 131C stores reusable paper which is sheets subjected to the color erasing process (less than 5 times), and the cassette 131D stores reusable paper (5 or more times).

The image forming unit 14 includes a transfer device 141 that transfers a toner image onto the sheet transported from the sheet supply unit 13 using the color-erasable toner, and a heater 142. The transfer device 141 includes developing devices 143Y to 143K that store the color-erasable toner for the respective colors, photoconductive drums 144Y to 144K that hold the respective color toner images, and an intermediate transfer belt 145 that transfers the toner images transferred by the photoconductive drums 144Y to 144K onto the sheet. The heater 142 functions as a fixing device that, when the image is formed on the sheet by the transfer device 141, heats and presses the sheet so as to fix the toner image onto the sheet.

In addition, when a sheet in which an image is formed using the color-erasable toner is transported from the sheet supply unit 13, the heater 142 functions as a color erasing device that heats the sheet so as to erase the color of the image on the sheet. The control unit 15 includes a processor 151, a memory 152 (storage unit), an HDD 153 (Hard Disk Drive), and an ASIC 154 (Application Specific Integrated Circuit) and controls the entire image forming apparatus 10.

Returning to FIG. 1, the PC 20 includes a display unit 21, an operation input unit 22, a control unit 23, and a network I/F 24. The display unit 21 displays an image. The operation input unit 22 receives an operation input of a user. The network I/F 24 transmits and receives information via a LAN.

The control unit 23 includes a processor 231, a memory 232 (storage unit), and an HDD 233 and controls the entire PC 20.

Figure 3:
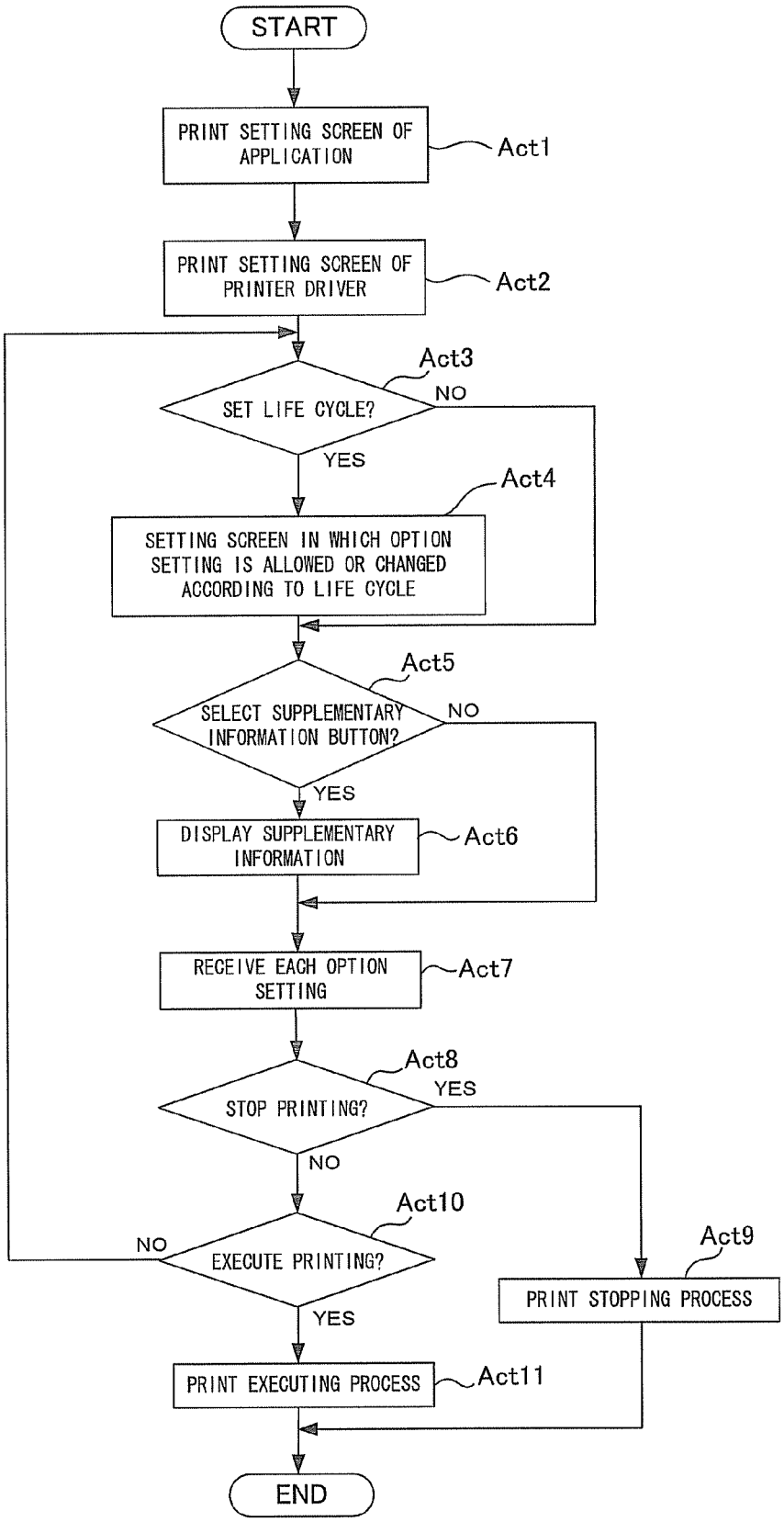
FIG. 3 is a flowchart showing a print control process of the image forming apparatus executed by a PC.

The memory 232 stores an OS 234 (Operating System), an application 235, a printer driver 236 corresponding to the image forming apparatus 10, and a setting table 237 (moreover, the HDD 233 may store various programs and the setting table 237). The processor 231 reads programs 234 to 236 (print setting programs) and the setting table 237 from the memory 232 to realize various functions. Hereinafter, a print control process of the image forming apparatus 10 executed by the PC 20 will be described with reference to the flowchart of FIG. 3.

The control unit 23 of the PC 20 displays a print setting screen of the application 235 on the display unit 21 (Act 1).

Figure 4:
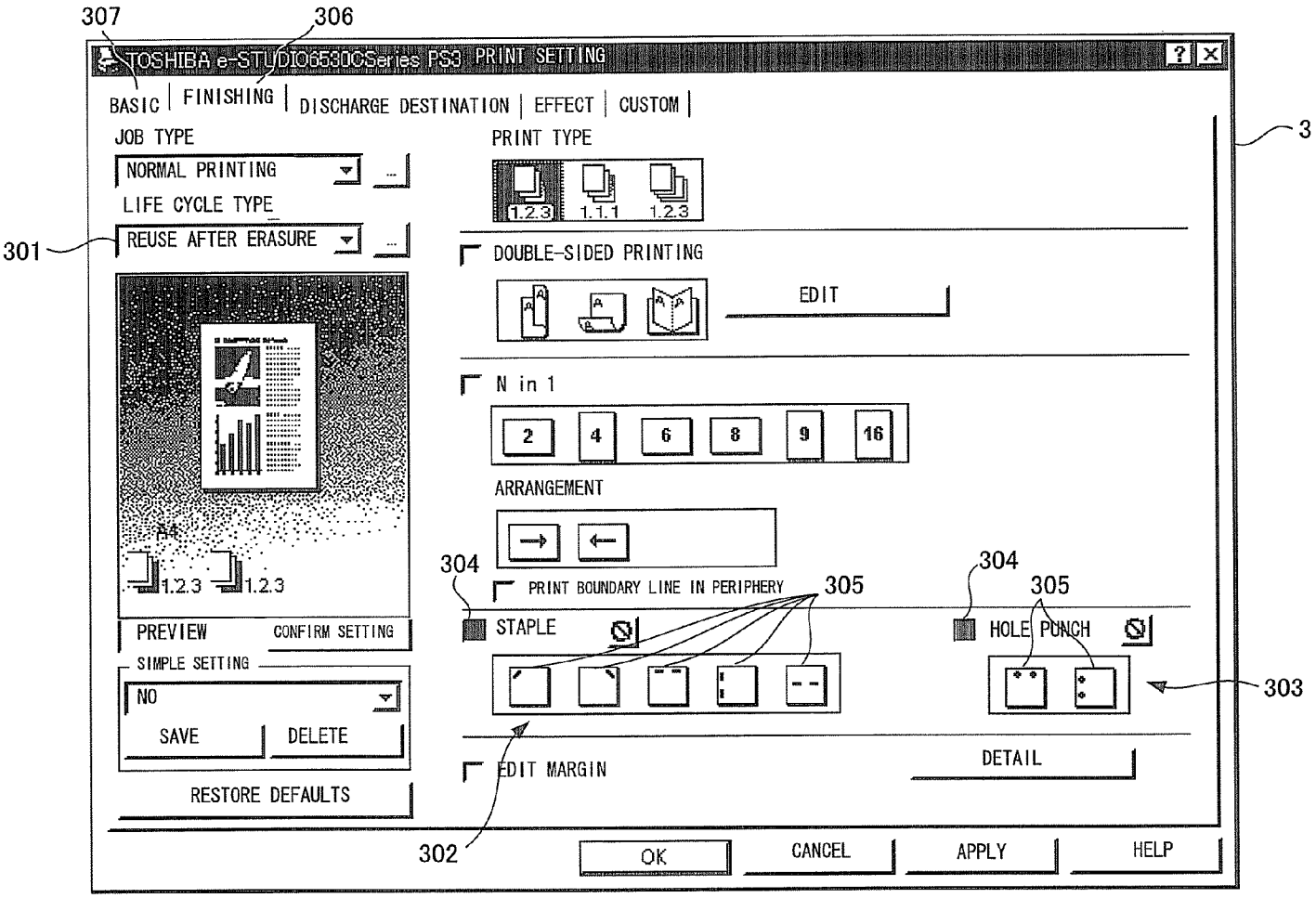
FIG. 4 is a diagram showing a print setting screen of a printer driver.

Next, when the image forming apparatus 10 used for printing is selected by the user on the print setting screen of the application 235 and thereafter a property button is selected by the user, as shown in FIG. 4, the control unit 23 displays a print setting screen 3 (hereinafter, sometimes referred to as a setting screen) of the printer driver 236 unique to the image forming apparatus 10 (Act 2).

In the setting screen 3, there is an option setting field for setting optional functions such as a double-sided function, an N in 1 printing function, a stapling function, and a hole punching function ON and OFF, and for selecting functions. In addition, in the setting screen 3, there is a selection field 301 for life cycles. The life cycle means a method of handling sheets after image formation, for example, a sheet reuse method or disposal method. Here, in general, the user uses the abundant functions of the printer, for example, the hole punching function or the stapling function without being aware of the sheet reuse method or the disposal method. However, when a sheet in which a document with a high security level is printed is disposed of, the sheet needs to be shredded, and staples need to be removed from the sheet before shredding. In addition, when an image is printed on a sheet using color-erasable toner, to erase the color from the sheet, staples need to be removed from the sheet before color erasure.

In addition, since the sheet is reused after the color erasure, if the sheet is hole-punched, there is an impediment to the reuse of the sheet. Here, in this embodiment, as the user selects the life cycle, the control unit 23 controls the setting screen 3 so that print setting corresponding to the selected life cycle is made.

In this embodiment, as the life cycles, incineration, shredding, reuse after erasure, recycle separation (as recycled paper), and external distribution are defined. As shown in FIG. 5, the memory 232 stores the setting table 237 in which each life cycle corresponds to setting instruction content of each option on the print setting screen. The setting instruction content of each option includes function restriction instruction content to disable setting and use of a predetermined function related to printing.

In the setting table 237, the incineration setting is used when sheets are incinerated during disposal after forming images on the sheets. Incineration corresponds to prohibition instructions of a plain paper use function of using plain paper in the cassette 131A and a reusable (less than 5 times) paper use function of using reusable paper (less than 5 times) in the cassette 131C. Incineration corresponds to instructions of enabling other functions of the image forming apparatus 10 to be set. The shredding setting is used when sheets are shredded during disposal and is mainly set for confidential documents. Shredding corresponds to prohibition instructions of a stapling function and the reusable paper (less than 5 times) use function. The reuse after erasure setting is used when sheets are subjected to color erasure after use so as to be reused. Reuse after erasure corresponds to prohibition instructions of the stapling function, a hole punching function, the plain paper use function, a rear paper use function of using rear paper in the cassette 131B, and a reusable paper (5 or more times) use function of using reusable paper (5 or more times) in the cassette 131D. The recycle separation setting is used when sheets after use are provided for an agent as recycled paper. Recycle separation corresponds to prohibition instructions of an N in 1 printing function, a single-sided printing function, the rear paper use function, and the reusable paper (less than 5 times) use function. The external distribution setting is used when sheets are externally distributed. External distribution corresponds to prohibition instructions of the rear paper use function, the reuse paper (less than 5 times) use function, and the reuse paper (5 or more times) use function.

After Act 2, if the life cycle is selected on the setting screen 3 (YES in Act 3), the control unit 23 acquires the setting instruction content of each option corresponding to the selected life cycle from the memory 232 and displays the setting screen on the basis of the acquired setting instruction content of each option (Act 4).

If reuse after erasure is selected as the life cycle, the control unit 23 acquires the setting instruction content of each option corresponding to reuse after erasure from the memory 232. In the setting instruction content of each option corresponding to reuse after erasure, the stapling function and the hole punching function are prohibited (FIG. 5). Here, the control unit 23 shows setting fields 302 and 303 of the stapling function and the hole punching function (FIG. 4) to be grayed out. The term grayed out means displaying, from setting fields of a predetermined function or selection icons, the setting fields of which setting is disabled or the selection icons of which selection is disabled.

In the setting field 303 of the hole punching function, there is a checkbox 304 for switching the hole punching function ON and OFF. When the checkbox 304 is checked, selection icons 305 showing functions (punch on the upper part of a sheet or punch on the left of a sheet) of the hole punching function are able to be selected. If reuse after erasure is selected as the life cycle, the control unit 23 shows the setting field 303 of the hole punching function to be grayed out. That is, the control unit 23 disables a checking operation of the checkbox 304 or disables selection of the selection icon 305.

In FIG. 4, the checkbox 304 is displayed as entirely black. However, in practice, the checkbox 304 is displayed with the same color as the background color of the setting screen 3, for example, entirely gray, such that the checkbox 304 is inoperable.

The setting screen 3 of FIG. 4 is a setting screen 3 in a finishing tab 306; however, a sheet selection field for image formation objects is in a setting screen of a basic tab 307.

If reuse after erasure is selected as the life cycle, in the sheet selection field, plain paper, rear paper, and reusable paper (5 or more times) are grayed out and thus cannot be selected, and only reusable paper (less than 5 times) is able to be selected.

Figure 6:
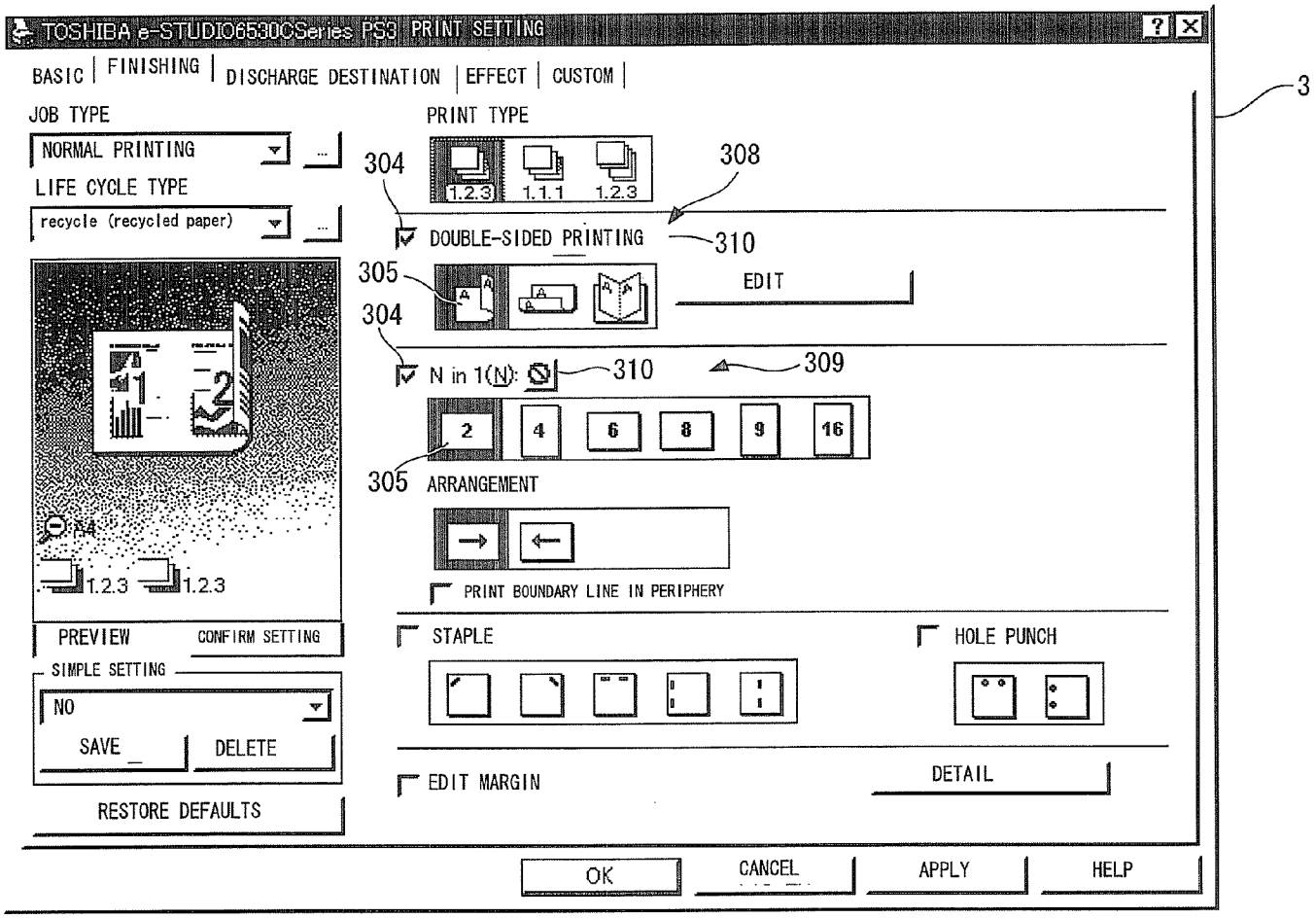
FIG. 6 is a diagram showing a setting screen in which a recycle separation is made to select a life cycle.

In addition, if recycle separation is selected as the life cycle, the control unit 23 acquires the setting instruction content of each option corresponding to recycle separation from the memory 232. In the setting table 237 of FIG. 5, the N in 1 printing function and the single-sided printing function corresponding to recycle separation are described to be prohibited. However, specifically, the setting instruction content related to the N in 1 printing function is content that instructs 2 in 1 printing, and the setting instruction content related to the single-sided printing function is content that instructs double-sided printing. Here, as shown in FIG. 6, if recycle separation (in FIG. 6, recycle (recycled paper)) is selected as the life cycle on the setting screen 3, the control unit 23 displays the setting screen 3 in which a setting field 309 of the N in 1 printing function is set to 2 in 1 printing, and a setting field 308 of the double-sided printing function is set to double-sided printing.

Specifically, the control unit 23 displays the setting screen 3 in which the checkbox 304 of the setting field 309 of the N in 1 printing function is checked, the selection icon 305 indicating setting of the 2 in 1 printing is selected, and the checkbox 304 and the selection icon 305 are inoperable.

In addition, in the setting screen 3, the setting field 308 of the double-sided printing function is also inoperable.

As such, the setting instruction content of each option in the setting table 237 includes function restriction instruction content that disables setting and use of predetermined functions (the stapling function, the hole punching function, and various sheet use functions) related to printing. The setting instruction content of each option in the setting table 237 also includes function restriction instruction content that disables setting of predetermined functions (the N in 1 printing function and the single-sided printing function) related to printing while being selected as specific functions.

Figure 7:
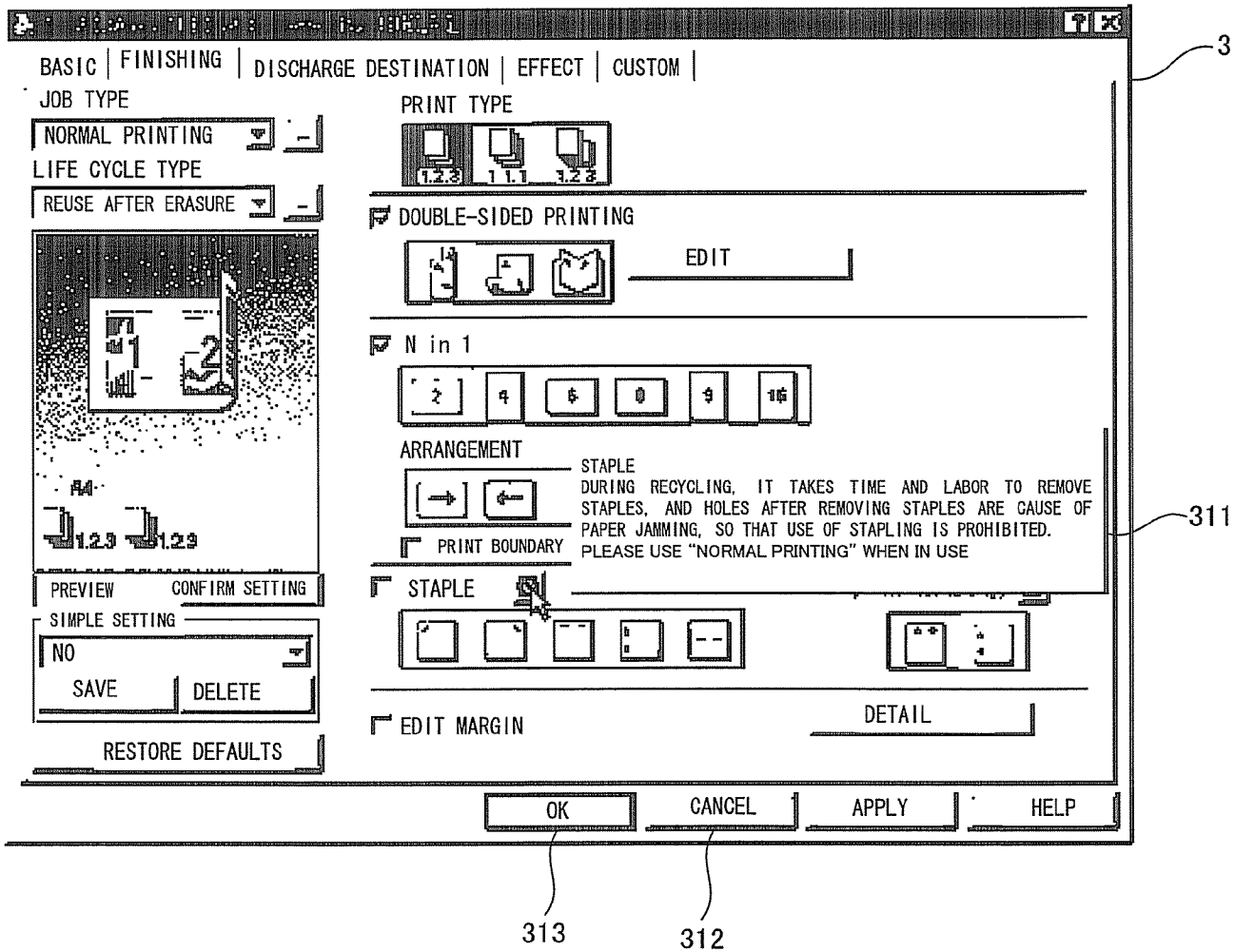
FIG. 7 is a diagram showing a setting screen when a prohibition mark button is clicked.

In addition, the control unit 23 displays, on the setting screen 3, a prohibition mark button 310 (supplementary information button) to correspond to the setting field 308 of a predetermined function setoff which setting is disabled. As shown in FIG. 7, if the prohibition mark button 310 is clicked or the like by the user and thus selected (YES in Act 5), the control unit 23 displays a display 311 showing a reason that use of the predetermined function corresponding to the prohibition mark button 310 is disabled and a condition for enabling the predetermined function to be used (Act 6).

Therefore, in this embodiment, the user sees the display 311 and understands the reason that the use of the predetermined function is disabled and can change the life cycle (NO in Act 10).

After the control unit 23 receives the selection of the life cycle on the setting screen 3 (Act 3) and the setting changes from the default setting in the setting options that can be set (Act 7), if a cancel button 312 shown in FIG. 7 is selected by the user (YES in Act 8), a print stopping process (Act 9) is executed. After the control unit 23 receives the selection of the life cycle on the setting screen 3 (Act 3) and each option setting (Act 7), if an OK button 313 shown in FIG. 7 is selected by the user, the control unit 23 closes the print setting screen 3 of a printer driver 236. If the OK button or the like is selected by the user on a print setting screen of the application 235 (YES in Act 10), the control unit 23 outputs a print instruction according to the print setting received on the print setting screen 3 of the printer driver 236 and on the print setting screen of the application 235 to the image forming apparatus 10 and causes the image forming apparatus 10 to execute printing (Act 11).

Figure 8:
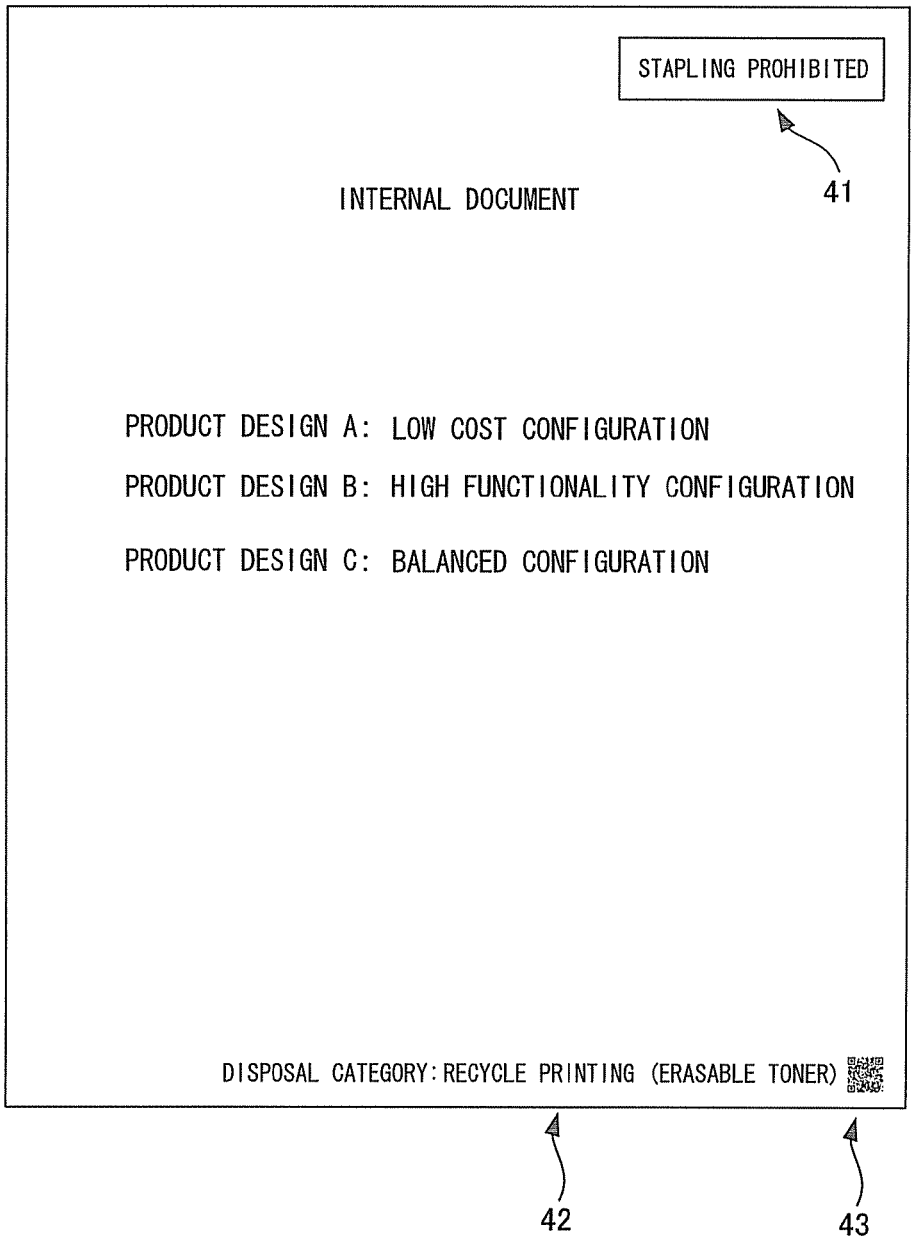
FIG. 8 is a diagram showing a print example by the image forming apparatus.

FIG. 8 is a diagram showing a print example by the image forming apparatus 10.

In addition, in Act 11, the control unit 23 prints, on a header, text information 41 that indicates the prohibition of the process of the predetermined function of which setting is disabled by the selection of the life cycle from being executed on sheets. For example, if reuse after erasure is selected as the life cycle, the control unit 23 prints, on the header, the text information 41 as "stapling prohibited" indicating prohibition of the process of the stapling function of which use is disabled from being executed on sheets. Here, the control unit 23 may also print on the header text information as "hole punching prohibited" indicating the prohibition of the process of the hole punching function of which use is disabled from being executed on sheets.

In addition, in Act 11, the control unit 23 prints text information 42 indicating the selected life cycle on a footer. For example, if reuse after erasure is selected as the life cycle, the text information 42 as "disposal category: recycle printing (erasable toner)" indicating that the life cycle is reuse after erasure is printed on the header. Moreover, the control unit 23 prints identification information 43 that means printing by color-erasable toner on the footer.

In addition, the image forming apparatus may be configured to select any one of color-erasable toner and ordinary toner without color erasing properties for image formation. In this case, the image forming apparatus may print the identification information that means printing by color-erasable toner on sheets during printing by color-erasable toner, and print identification information that means printing by toner without color erasing properties on sheets during printing by ordinary toner without color erasing properties. Print positions of the text information 42 and the identification information 43 may be arbitrary positions in the margin parts of sheets.

Second Embodiment

Hereinafter, like functional portions which are the same as those of the above-described embodiment are denoted by like reference numerals, and detailed description thereof will be omitted.

Figure 9:
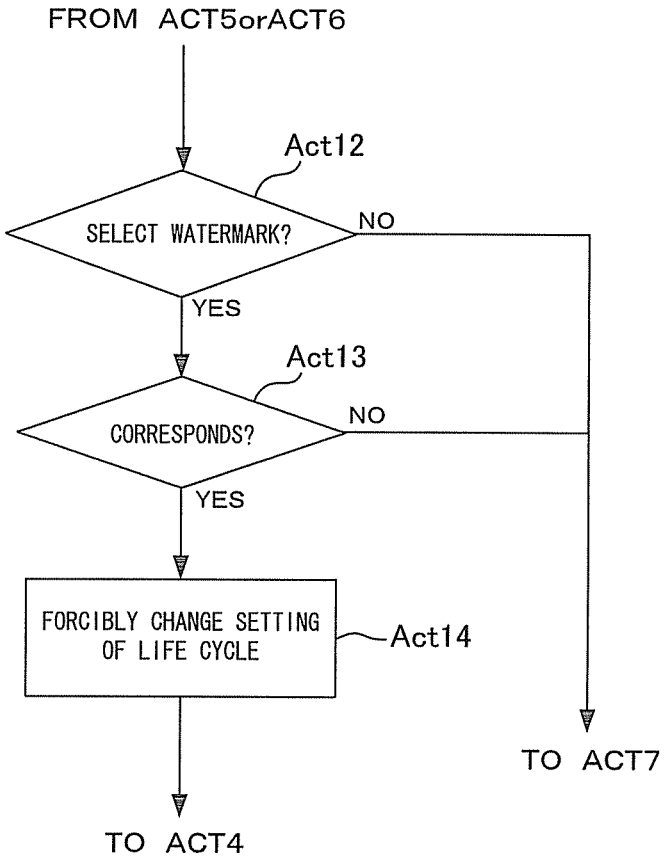
FIG. 9 is a flowchart showing a print control process executed by the PC.
Figure 10:
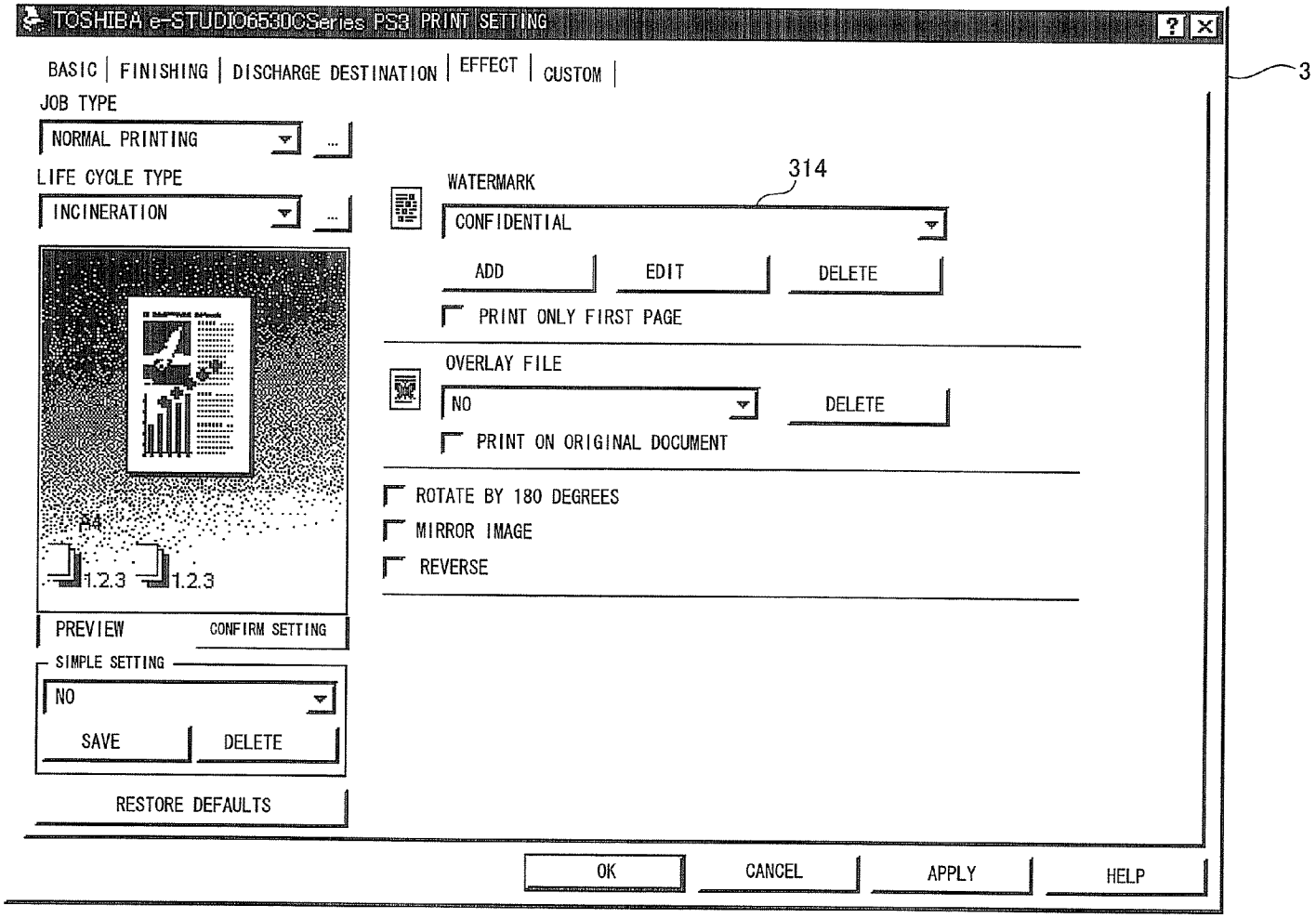
FIG. 10 shows a setting screen displayed by the PC.

FIG. 9 is a flowchart showing a print control process executed by the PC 20, and FIG. 10 shows the print setting screen 3 displayed by the PC 20.

In this embodiment, the memory 232 stores a watermark table in which predetermined watermarks correspond to the life cycles. In many cases, documents with watermarks attached for confidential, Internal Use Only, and the like are shredded during disposal. Here, in the watermark table, the watermarks for confidential, Internal Use Only, and the like correspond to shredding in the life cycle.

If the watermark is selected in a watermark setting field 314 on the print setting screen 3 (YES in Act 12), the control unit 23 determines whether or not the selected watermark corresponds to a predetermined life cycle in the watermark table (Act 13).

Figure 11:
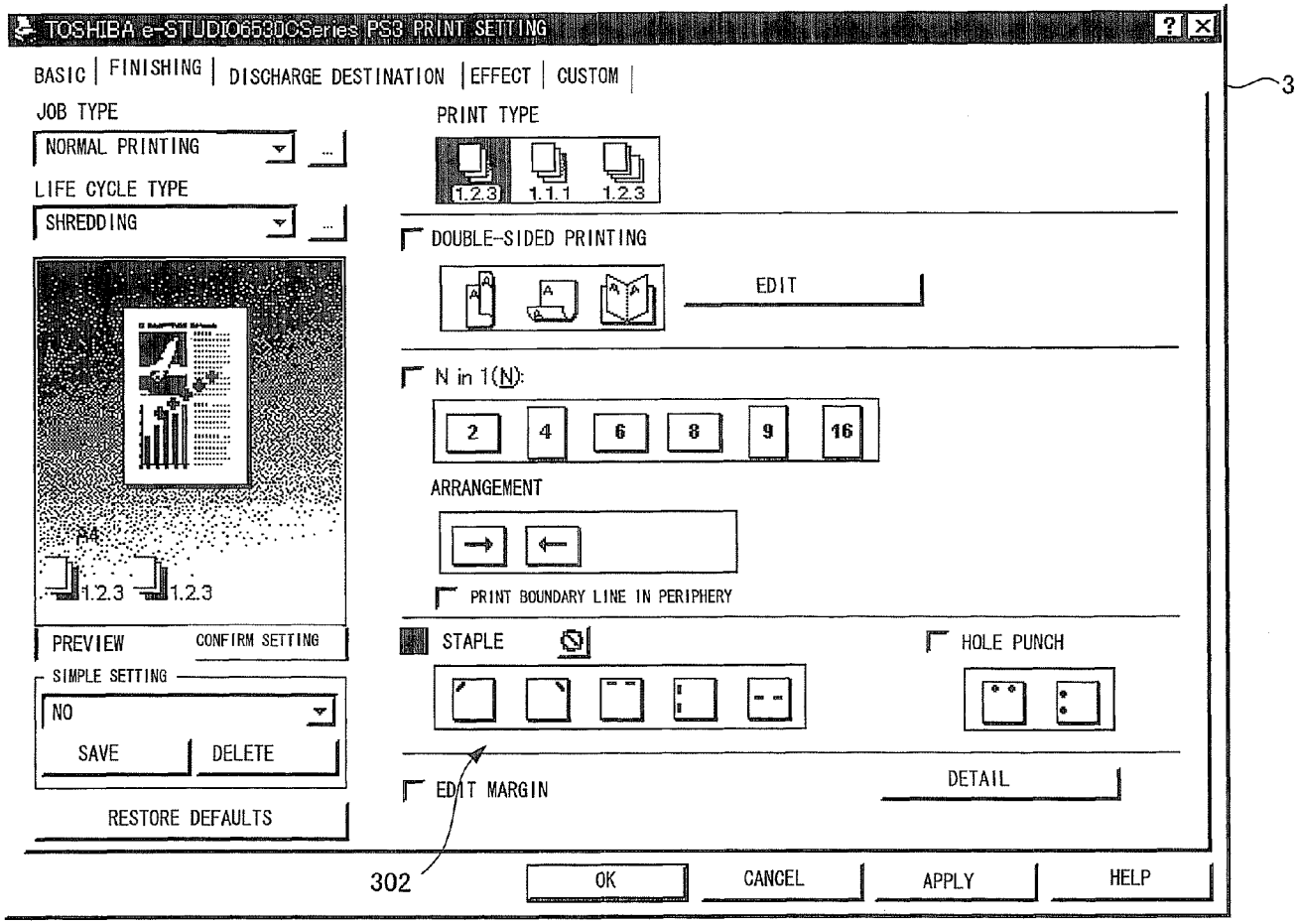
FIG. 11 is a diagram showing a setting screen in which the life cycle is forcibly changed to shredding.

If the selected watermark corresponds to the predetermined life cycle in the watermark table (YES in Act 13), the control unit 23 forcibly changes the life cycle received on the print setting screen 3 to the life cycle corresponding to the selected watermark (Act 14). For example, if incineration is selected as the life cycle on the print setting screen 3 (FIG. 10), as shown in FIG. 11, the life cycle is forcibly changed to shredding.

In addition, the control unit 23 acquires the setting instruction content of each option corresponding to the forcibly changed life cycle from the memory 232 and displays the setting screen 3 on the basis of the acquired setting instruction content of each option (Act 4). For example, if the life cycle is changed from incineration to shredding, the control unit 23 displays a setting screen in which the setting field 302 of the stapling function is grayed out.

Third Embodiment

Figure 12:
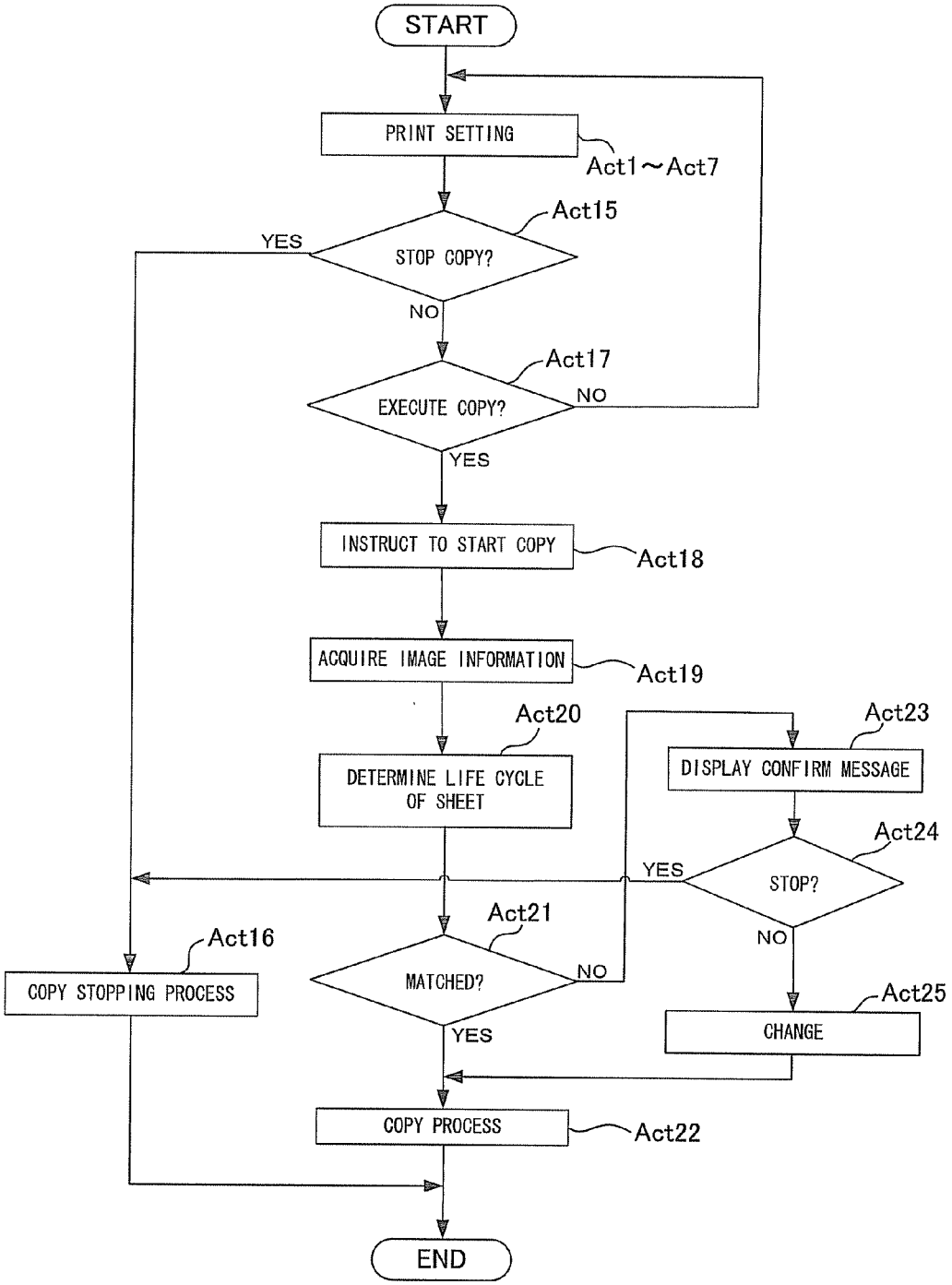
FIG. 12 is a flowchart showing a copy process executed by the image forming apparatus.

FIG. 12 is a flowchart showing a copy process executed by the image forming apparatus 10.

In this embodiment, the control unit 15 of the image forming apparatus 10 determines the life cycle of a sheet from an image of the sheet if the copy process is executed, and executes the copy process according to setting corresponding to the life cycle. Hereinafter, the detailed process executed by the control unit 15 will be described.

Copy settings Act 1 to Act 7 executed by the control unit 15 are the same as the print settings Act 1 to Act 7 according to the first and second embodiments. That is, the control unit 15 receives a life cycle on the copy setting screen (Act 1 to Act 3). Then, the control unit 15 acquires the setting instruction content of each option corresponding to the received life cycle from the memory 152, displays the setting screen on the basis of the acquired setting instruction content of each option, and receives the copy setting on the setting screen (Act 4 to Act 7). After the control unit 15 receives the copy setting on the setting screen, if the cancel button or the like is selected by the user (YES in Act 15), the control unit 15 executes a copy stopping process (Act 16). After the control unit 15 receives the copy setting on the setting screen (NO in Act 15 and Act 17), if the OK button or the like is selected by the user, the control unit 15 outputs a copy start instruction to the image forming apparatus 10 on the basis of the setting received on the copy setting screen (Act 18).

Then, the image forming apparatus 10 reads the image of the sheet (original document) and outputs image information to the control unit 15 (Act 19).

The control unit 15 determines the life cycle of the sheet on the basis of the image information (Act 20). Specifically, the control unit 15 recognizes text information on a sheet on the basis of, for example, image information (Optical Character Recognition) and determines the life cycle of the sheet from the text information on the sheet using the text information registered on the memory 152. For example, if text information indicating confidential or Internal Use Only appears on the text information of the sheet a threshold number of times or more, the control unit 15 determines the life cycle of the sheet as shredding. In addition, if the text information 42 such as incineration, shredding, reuse after erasure (recycle printing), recycle separation, or external distribution or text information corresponding to this text information is present on the footer or the like of the sheet (see FIG. 8), the control unit 15 determines the life cycle of the sheet as the life cycle indicated by the text information 42. If position information and the text information 42 indicating the life cycle are matched with a predetermined condition, for example, if the text information 42 indicating the life cycle is at a predetermined position in the footer or the like, the control unit 15 may determine the life cycle of the sheet as the life cycle indicated by the text information 42. If the text information 42 indicating the life cycle is present in the vicinity of the text information as disposal category, the control unit 15 may determine the life cycle of the sheet as the life cycle indicated by the text information 42. The control unit 15 may determine the life cycle of the sheet on the basis of the identification information 43 indicating the life cycle printed on the sheet.

Subsequently, the control unit 15 determines whether or not the life cycle determined on the basis of the image information of the sheet is matched with the life cycle received on the setting screen (Act 21), and if they are matched (YES in Act 21), the control unit 15 prints the image on the sheet on the basis of the image information (Act 22). Here, as in the above embodiments, the control unit 15 prints on the header the text information 41 indicating the prohibition of the process of the predetermined function of which use is disabled by the selection of the life cycle from being executed on the sheet and prints on the footer the text information 42 indicating the selected life cycle.

The control unit 15 determines that the life cycle determined on the basis of the image information of the sheet is not matched with the life cycle received on the setting screen (NO in Act 21), a message indicating that the life cycle of the sheet is not matched with the life cycle received on the setting screen is displayed on the display unit 11, and a screen in which whether or not the copy process is stopped can be selected is displayed on the display unit 11 (Act 23).

If continuation of the copy process is selected by the user (NO in Act 24), the control unit 15 continues to execute the copy process according to the setting forcibly changed to the life cycle determined from the image information from the life cycle received on the setting screen (Act 25).

If stopping of the copy process is selected by the user (YES in Act 24), the control unit 15 executes a copy stopping process (Act 16).

In addition, control of the setting during the image formation of the embodiments and control during the copy process may be executed by either of the PC 20 and the image forming apparatus 10, or may be based on instructions from a mobile terminal, such as a smartphone or a cloud service (SaaS).

The PC 20 or the image forming apparatus 10 may acquire the setting table 237 from a storage device that can communicate with the PC 20 or the image forming apparatus 10.

The selection field 301 of the life cycle is present on the setting screen 3. However, the life cycle may be selected on a job type selection field.

The image forming apparatus 10 may select one from image formation by toner having color erasing properties and image formation by ordinary toner without color erasing properties.

In addition, the PC 20 or the image forming apparatus 10 may be configured to form an image using ordinary toner for the life cycle (for example, incineration).

As a recording medium, any type of recording medium on which programs can be stored and from which the programs can be read by a computer can be employed. Specifically, as the recording medium, for example, there are internal storage devices such as a ROM or RAM mounted in a computer, CD-ROMs, flexible disks, DVD discs, magneto-optical discs, portable storage media such as IC cards, databases for storing computer programs, or other computers and databases thereof. Functions obtained by installing or downloading may be realized by cooperating with the OS or the like in an apparatus. A part or the entirety of the program may be an execution module that is dynamically generated.

The order in the process according to the above embodiments may be different from the order exemplified in the above embodiments.

As described above, according to the technique described in the specification, a technique capable of reducing additional work during handling of sheets after image formation can be provided.

While certain embodiments have been described, these embodiments have been presented by way of example only, and are not intended to limit the scope of invention. Indeed, the novel embodiments described herein may be embodied in a variety of other forms; furthermore, various omissions, substitutions and changes in the form of the embodiments described herein may be made without departing from the sprit of the inventions.

The accompanying claims and their equivalents are intended to cover such forms or modifications as would fall within the scope and spirit of the inventions.

What is claimed is:

1. An image forming apparatus comprising:

a display unit;

an operation input unit which receives an operation input;

a developing device that stores a color-erasable colorant;

a storage unit which stores function restriction instruction content in association with a sheet handling method, the function restriction instruction content disabling setting and use of a predetermined function related to printing based on the sheet handling method related to disposal and reuse after image formation;

a control unit which displays a setting screen for setting each function related to printing and selecting the sheet handling method on the display unit, acquires the function restriction instruction content corresponding to the selected sheet handling method from the storage unit when the sheet handling method is selected, displays the setting screen in which setting and use of the predetermined function are disabled on the display unit on the basis of the acquired function restriction instruction content, and receives a print setting on the setting screen; and an image forming unit which is controlled by the control unit on the basis of the setting received on the setting screen and forms an image on a sheet by the colorerasable colorant, wherein the control unit displays a supplementary information button to correspond to a setting field or a selection icon of the predetermined function, and when the supplementary information button is selected, displays a reason that use of the predetermined function is disabled and a condition for enabling the predetermined function of which use is disabled, to be used.

2. The apparatus according to claim 1, wherein the control unit displays, as the setting field or the selection icon of the predetermined function, a setting field of which setting is disabled or a selection icon of which selection is disabled.

3. The apparatus according to claim 1, further comprising an image reading unit which reads an image of an original document, wherein the control unit, when a copy process is executed, after receiving the setting of each function and the selection of the sheet handling method on the setting screen, reads the image of the sheet by controlling the image reading unit, determines a sheet handling method after image formation on the basis of the read image information, and if the sheet handling method determined from the image information is different from the sheet handling method received on the setting screen, forms the image on the sheet using the image forming unit according to the print setting forcibly changed to the sheet handling method determined from the image information from the sheet handling method received on the setting screen.

4. The apparatus according to claim 1, further comprising an image reading unit which reads an image of an original document, wherein the control unit, when a copy process is executed, after receiving the setting of each function and the selection of the sheet handling method on the setting screen, reads the image of the sheet by controlling the image reading unit, determines a sheet handling method after image formation on the basis of the read image information, displays a screen in which whether or not to stop the copy process can be selected if the sheet handling method determined from the image information is different from the sheet handling method received on the setting screen, continues to execute the copy process by forcibly changing the sheet handling method received on the setting screen to the sheet handling method determined from the image information if continuation of the copy process is selected, and stops the copy process if stopping of the copy process is selected.

5. The apparatus according to claim 1, wherein the storage unit stores a watermark table in which a predetermined watermark corresponds to a predetermined sheet handling method, the control unit, when setting of a watermark is received on the setting screen, if the received watermark corresponds to the predetermined sheet handling method in the watermark table, forms the image on the sheet using the image forming unit according to the print setting forcibly changed to the predetermined sheet handling method corresponding to the received watermark from the sheet handling method received on the setting screen.

6. The apparatus according to claim 1, wherein the control unit prints text information indicating prohibition of the processing on the sheet by the predetermined function of which use is disabled on the sheet.

7. The apparatus according to claim 1, wherein the control unit prints text information indicating the selected sheet handling method on the sheet.

8. The apparatus according to claim 1, wherein the control unit prints identification information by printing color-erasable colorant on the sheet when the printing by the color-erasable colorant is set.

9. The apparatus according to claim 1, wherein the control unit disables use of a stapling function or a hole punching function when printing by color-erasable colorant is set.

10. An image forming method of forming an image on a sheet, which is used by an image forming apparatus including a display unit, an operation input unit that receives an operation input, a developing device that stores a color-erasable colorant, a storage unit that stores function restriction instruction content in association with a sheet handling method, the function restriction instruction content disabling setting and use of a predetermined function related to printing based on the sheet handling method related to disposal and reuse after image formation, and an image forming unit that forms an image on a sheet, the method comprising:

displaying a setting screen for setting each function related to printing and selecting the sheet handling method on the display unit;

acquiring the function restriction instruction content corresponding to the selected sheet handling method from the storage unit when the sheet handling method is selected;

displaying the setting screen in which setting or use of the predetermined function is disabled on the display unit on the basis of the acquired function restriction instruction content;

receiving print settings on the setting screen; and forming a color-erasable colorant image on the sheet by controlling the image forming unit on the basis of the settings received on the setting screen, wherein, when the sheet handling method is selected, a supplementary information button is displayed to correspond to the setting field or the selection icon of the predetermined function on the basis of the function restriction instruction content corresponding to the selected sheet handling method, and when the supplementary information button is selected, a reason that use of the predetermined function is disabled and a condition for enabling the predetermined function of which use is disabled, to be used are displayed.

11. The method according to claim 10, wherein, when the sheet handling method is selected, on the basis of the function restriction instruction content corresponding to the selected sheet handling method, a setting field or a selection icon of which selection is disabled is displayed as a setting field or a selection icon of the predetermined function.

12. The method according to claim 10, wherein the image forming apparatus includes an image reading unit which reads an image of an original document, when a copy process is executed, after receiving the setting of each function and the selection of the sheet handling method on the setting screen, the image of the sheet is read by controlling the image reading unit, a sheet handling method after image formation is determined on the basis of the read image information, and if the sheet handling method determined from the image information is different from the sheet handling method received on the setting screen, the image is formed on the sheet by the image forming unit according to the print setting forcibly changed to the sheet handling method determined from the image information from the sheet handling method received on the setting screen.

13. A print setting method of an image forming apparatus comprising:

storing function restriction instruction content in association with a sheet handling method, the function restriction instruction content disabling setting and use of a predetermined function related to printing based on the sheet handling method related to disposal and reuse after image formation;

displaying a setting screen for setting each function related to a color-erasable colorant printing and selecting the sheet handling method on a display unit;

acquiring the function restriction instruction content corresponding to the selected sheet handling method from the storage unit when the sheet handling method is selected;

displaying the setting screen in which setting and use of the predetermined function are disabled on the display unit on the basis of the acquired function restriction instruction content; and instructing the image forming apparatus to execute printing on the basis of setting received on the setting screen, wherein, when the sheet handling method is selected, a supplementary information button is displayed to correspond to the setting field or the selection icon of the predetermined function on the basis of the function restriction instruction content corresponding to the selected sheet handling method, and when the supplementary information button is selected, a reason that use of the predetermined function is disabled and a condition for enabling the predetermined function of which use is disabled, to be used are displayed.

14. The method according to claim 13, wherein, when the sheet handling method is selected, on the basis of the function restriction instruction content corresponding to the sheet handling method, a setting field or a selection icon of which is disabled is displayed as a setting field or a selection icon of the predetermined function.

15. A non-transitory computer-readable recording medium which non-temporarily stores a print setting program of an image forming apparatus printing by a color-erasable colorant, the print setting program causing a computer to execute the processes of:

storing function restriction instruction content in association with a sheet handling method, the function restriction instruction content disabling setting and use of a predetermined function related to printing based on the sheet handling method related to disposal and reuse after image formation;

displaying a setting screen for setting each function related to printing and selecting the sheet handling method on a display unit;

acquiring the function restriction instruction content corresponding to the selected sheet handling method from the storage unit when the sheet handling method is selected;

displaying the setting screen in which setting and use of the predetermined function are disabled on the display unit on the basis of the acquired function restriction instruction content; and instructing the image forming apparatus to execute printing by the color-erasable colorant on the basis of setting received on the setting screen, wherein, when the sheet handling method is selected, a supplementary information button is displayed to correspond to the setting field or the selection icon of the predetermined function on the basis of the function restriction instruction content corresponding to the selected sheet handling method, and when the supplementary information button is selected, a reason that use of the predetermined function is disabled and a condition for enabling use of the predetermined function of which use is disabled are displayed.

16. The recording medium according to claim 15, wherein, when the sheet handling method is selected, on the basis of the function restriction instruction content corresponding to the selected sheet handling method, a setting field or a selection icon of which selection is disabled is displayed as a setting field or a selection icon of the predetermined function.

* * * * *